US010667656B2

(12) United States Patent
Jackson

(10) Patent No.: US 10,667,656 B2
(45) Date of Patent: Jun. 2, 2020

(54) TOILET PAPER ROLL HOLDER

(71) Applicant: Audrey Jackson, Las Vegas, NV (US)

(72) Inventor: Audrey Jackson, Las Vegas, NV (US)

( * ) Notice: Subject to any disclaimer, the term of this patent is extended or adjusted under 35 U.S.C. 154(b) by 171 days.

(21) Appl. No.: 15/806,772

(22) Filed: Nov. 8, 2017

(65) Prior Publication Data

US 2018/0125307 A1 May 10, 2018

Related U.S. Application Data

(60) Provisional application No. 62/419,771, filed on Nov. 9, 2016.

(51) Int. Cl.

| | |
|---|---|
| ***A47K 10/10*** | (2006.01) |
| ***A47K 10/38*** | (2006.01) |
| ***A47K 17/00*** | (2006.01) |
| ***A47K 11/04*** | (2006.01) |

(52) U.S. Cl.

CPC ..... *A47K 10/10* (2013.01); *A47K 10/3836* (2013.01); *A47K 17/00* (2013.01); *A47K 11/04* (2013.01)

(58) Field of Classification Search

CPC .... A47K 10/10; A47K 10/3836; A47K 11/04; A47K 17/00

See application file for complete search history.

(56) References Cited

U.S. PATENT DOCUMENTS 2,518,328 A 8/1950 George
3,837,597 A * 9/1974 Bourhenne ..... B65H 49/20 242/129
4,513,923 A * 4/1985 Ulics ..... A47K 10/38 242/598.5
5,529,260 A * 6/1996 Wirick ..... A47K 10/38 242/596.8
5,690,301 A * 11/1997 Shelton ..... B65H 49/327 242/129
D414,638 S * 10/1999 Brightbill ..... D6/523
D427,829 S * 7/2000 Fleming ..... D6/523
D431,947 S * 10/2000 Kopcak ..... D6/523
6,305,035 B1 * 10/2001 Morris ..... A47K 10/40 242/588
6,634,592 B1 * 10/2003 Berousek ..... B65H 49/32 242/404.2
7,306,185 B1 * 12/2007 Miller ..... A47K 10/3836 242/592

(Continued)

*Primary Examiner* — William A. Rivera

(74) *Attorney, Agent, or Firm* — Boudwin Intellectual Property; Daniel Boudwin

(57) ABSTRACT

A toilet paper roll holder for portable toilets. The device includes an elongated member including a channel configured to removably receive a leg of a commode and a support arm configured to operably support a roll of toilet paper thereon. The channel includes a length ranging between 16 inches to 22 inches in order to accommodate differently sized commodes. The support arm includes a horizontal portion extending horizontally outwardly from a proximal end of the elongated member and a vertical portion extending vertically outwardly from an end of the horizontal portion, such that the vertical portion is orthogonal relative to the horizontal portion and parallel relative to the elongated member. A fastener disposed on the elongated member is configured to removably secure the leg of a commode within the longitudinal channel.

9 Claims, 2 Drawing Sheets

(56) References Cited

U.S. PATENT DOCUMENTS

| | | | | |
|---|---|---|---|---|
| 7,360,739 | B1 | 4/2008 | Horvat | |
| D600,478 | S * | 9/2009 | Linyear | D6/523 |
| D707,465 | S * | 6/2014 | Hutchins | D6/523 |
| 9,016,649 | B2 * | 4/2015 | Nolle | B65H 49/26 242/594.3 |
| 2010/0083432 | A1 * | 4/2010 | Osier | A47K 10/3836 4/254 |
| 2014/0332619 | A1 | 11/2014 | Yang | |
| 2015/0223649 | A1 | 8/2015 | Whitfield | |

* cited by examiner

TOILET PAPER ROLL HOLDER

CROSS REFERENCE TO RELATED APPLICATIONS

This application claims the benefit of U.S. Provisional Application No. 62/419,771 filed on Nov. 9, 2016. The above identified patent application is herein incorporated by reference in its entirety to provide continuity of disclosure.

BACKGROUND OF THE INVENTION

The present invention relates to toilet paper holding devices. More specifically, the present invention related to a toilet paper roll holder including a channel for removably receiving a leg of a bedside commode and a toilet paper support arm for supporting the toilet paper thereon.

It is sometimes necessary or convenient to use a portable commode next to the bed of an infirm patient. For instance, elderly persons and patients recovering from an illness or surgery sometimes lack the physical strength needed to walk unassisted from their bed to a conventional bathroom facility in order to use the toilet. It also may be more convenient for a patient to use a bedside commode if they have medical equipment connected to their bodies, such as an IV tube or respiratory device, or if they are physically impaired due to a cast or other obstruction which makes it difficult to walk to a restroom. It is therefore not uncommon to find the use of bedside commodes in hospitals, nursing homes, and even private residences of elderly or recovering patients.

Despite their widespread and longstanding use, bedside commodes have not been known to include means to conveniently and effectively hold a roll of toilet paper in a manner that is most convenient for a user. Any person who has had the unfortunate need to use a bedside commode, as well as any caregiver who has assisted an infirm patient, knows all too well that the toilet paper is almost always out of reach and, many times, out of sight when it is needed. Often, patients must suffer the indignity of having to call for someone to bring them a roll of toilet paper while seated on the portable commode.

Moreover, current toilet paper holding devices meant to remedy the aforementioned shortcomings are not configured in such a way that they do not interfere with the use of the bedside commode. For instance, current toilet paper holding devices used with bedside commodes are configured to attach to an arm rest of the bedside commode, whereby the device suspends the toilet paper roll underneath the arm rest and immediately adjacent the seat and waste receptacle. Though well within reach, the proximity of the toilet paper roll to the waste receptacle is uncomfortable. Further, since they attach to the arm rest of the commode, they obstruct the arm rest of the commode while in use and interfere with the usage of the commode in general.

Accordingly, in view of the aforementioned shortcomings in the healthcare field, and particularly relating to the use of bedside commodes, there remains an urgent need for an inexpensive toilet paper roll holder which is particularly adapted for convenient, quick attachment to all brands and styles of bedside commodes in order to operably support a roll of toilet paper within convenient reach of a person seated on the commode, while neither obstructing the arm rest nor interfering with the use of the commode.

SUMMARY OF THE INVENTION

In view of the foregoing disadvantages inherent in the known types of toilet paper holding devices now present in the prior art, the present invention provides a toilet paper roll holder wherein the same can be utilized for providing convenience for the user when using a bedside commode.

In one example of the present invention, the toilet paper roll holder comprises an elongated member including a distal end, a proximal end, and a longitudinal channel extending longitudinally between the distal end and the proximal end. The longitudinal channel includes a longitudinal, linear length ranging between 16 inches to 22 inches in order to accommodate commodes including a seat height ranging from 16 inches to 22 inches. A toilet paper support arm extending vertically outwardly from the proximal end of the elongated member includes a horizontal portion and a vertical portion. The horizontal portion includes a planar plate extending horizontally outwardly from the proximal end, such that the horizontal portion is orthogonal relative to the elongated member. The vertical portion includes a tubular member extending vertically outwardly from an end of the horizontal portion, such that the vertical portion is orthogonal relative to the horizontal portion and parallel relative to the elongated member. A fastener disposed on the elongated member is configured to removably secure the leg of a commode within the longitudinal channel.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
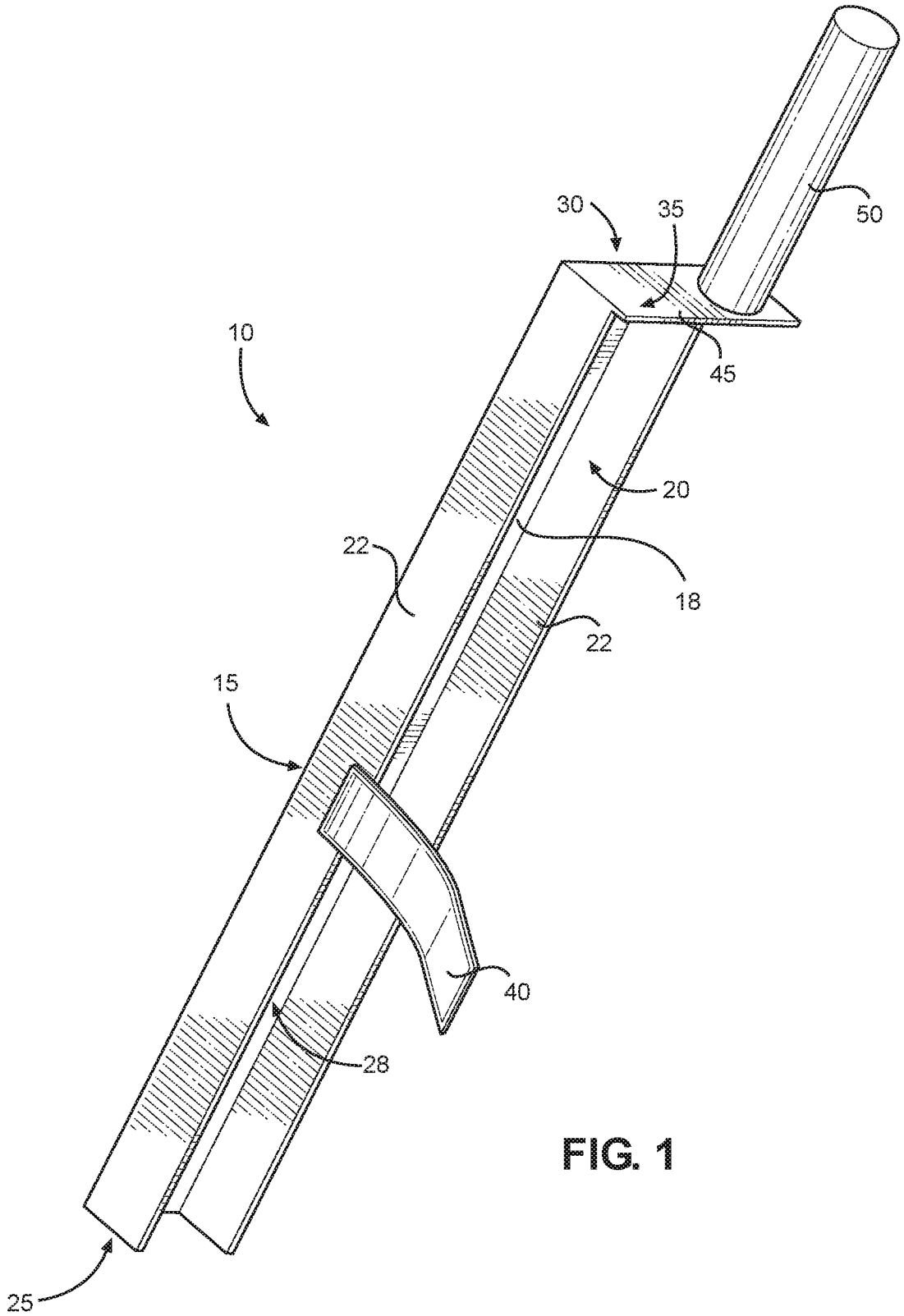
FIG. 1 shows a perspective view of the toilet paper roll holder according to one embodiment of the present invention.

Reference is made herein to the attached drawings. Like reference numerals are used throughout the drawings to depict like or similar elements of the toilet paper roll holder. The figures are intended for representative purposes only and should not be considered to be limiting in any respect.

Referring now to FIG. 1, there is shown a perspective view of the toilet paper roll holder. The present invention comprises a toilet paper roll holder 10 configured removably attach, longitudinally, to a leg of a commode in order to operably support a roll of toilet paper within convenient reach of a person seated on the commode, while not obstructing the arm rest and interfering with the use of the commode. The toilet paper roll holder 10 includes an elongated member 15 configured to support a roll of toilet paper at a height approximately equal to the height of the seat of a commode. Therefore, as conventional commodes include a seat height ranging from 16 inches to 22 inches, the elongated member 15 in turn includes a longitudinal, linear length ranging between 16 inches to 22 inches.

The elongated member 15 includes a rear wall 18 opposing an open front wall 20, a pair of longitudinally extending sidewalls 22 extending outwardly from a perimeter edge of the rear wall 18, an open distal end 25, a closed proximal end 30, a toilet paper support arm 35, and a fastener 40 for removably attaching the elongated member 15 to a leg of a commode. The rear wall 18, the open front wall 20, and the pair of longitudinally extending sidewalls 22 define a longitudinal channel 28 extending along a length of the elongated member 15 between the distal end 25 and the proximal end 30. The longitudinal channel 28 is sized to receive the leg of the commode therein, so as to partially enclose the leg within the elongated member 15, as show in FIG. 2. In one embodiment, the longitudinal channel 28 is configured to engage and secure the leg of a commode therein via a friction fit. The open nature of the distal end 25 facilitates mounting of the elongated member 15 onto the leg of a commode by enabling the open distal end 25 to receive the feet or the lower portion of the leg of the commode when mounting the elongated member 15 thereon. The closed proximal end 30 prevents the elongated member 15 from sliding downward along the leg of the commode during use.

The support arm 35 extends vertically outwardly from the proximal end 30 of the elongated member 15 and includes a horizontal portion 45 and a vertical portion 50. The horizontal portion 45 is affixed to the elongated member 30 such that it forms the closed proximal end 30, and extends horizontally outwardly therefrom, such that the horizontal portion 45 is orthogonal relative to the elongated member 15 and the longitudinal channel 28. In the depicted embodiment, the horizontal portion 45 comprises a planar plate for supporting a roll of toilet paper flush thereon. The vertical portion 50 is affixed to an end of the horizontal portion 45 and extends vertically outwardly therefrom, such that the vertical portion 50 is orthogonal relative to the horizontal portion 45 and parallel relative to the elongated member 15. In the depicted embodiment, the vertical portion 50 includes a tubular member sized and configured to receive the hollow interior of the cardboard cylinder of a toilet paper roll.

Figure 2:
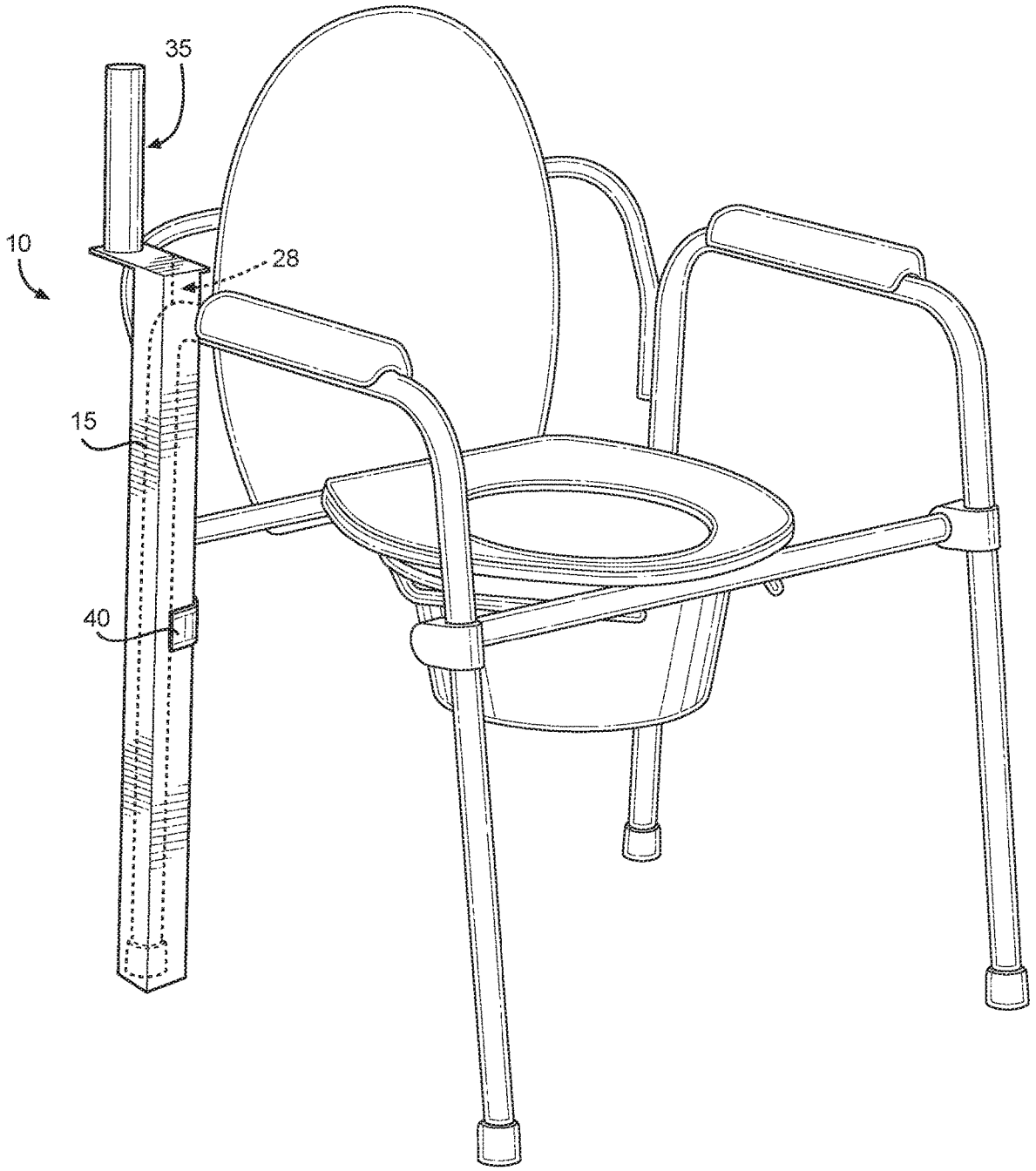
FIG. 2 shows a perspective view of the toilet paper roll holder in use according to one embodiment of the present invention.

The elongated member 15 and the support arm 35 are positioned such that each is disposed along the same plane, although the horizontal portion 45 is perpendicular to both the elongated member 15 and the vertical portion 50. Moreover, the elongated member 15 and the support arm 35 are positioned such that a longitudinal axis of the elongated member 15 is offset relative to a longitudinal axis of the vertical portion 50 of the support arm 35. The aforementioned configuration of the support arm 35 positions the vertical portion 50 rearwardly, i.e., behind, the leg and the arm rest of the commode when the toilet paper roll holder 10 is mounted thereon, as shown in FIG. 2, such that toilet paper mounted thereon does not obstruct the arm rest nor interfere with the usage of the commode, while still being within arm's reach.

The fastener 40 is disposed along the longitudinal length of the elongated member 15. The fastener 40 includes a strap configured to removably secure the elongated member 15 within the longitudinal channel 28, as shown in FIG. 2. In the depicted embodiment, the fastener 40 includes a hook and loop mating closure for removably attaching the elongated member 15 to the longitudinal length of the leg of a commode.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet paper roll holder, comprising:

an elongated member including a distal end, a proximal end, and a longitudinal channel extending longitudinally between the distal end and the proximal end, the longitudinal channel sized and configured to receive a leg of a commode therein, an arm extending vertically outwardly from the proximal end of the elongated member, the arm including a horizontal portion and a vertical portion, the horizontal portion extending horizontally outwardly from the proximal end such that the horizontal portion is orthogonal relative to the elongated member, the vertical portion extending vertically outwardly from an end of the horizontal portion such that the vertical portion is orthogonal relative to the horizontal portion and parallel relative to the elongated member;

a fastener configured to removably attach the elongated member to the leg of the commode;

wherein the elongated member comprises a rear wall opposing an open front wall, a pair of longitudinally extending sidewalls extending orthogonally outwardly from an edge of the rear wall, such that the rear wall, the open front wall, and the pair of longitudinally extending sidewalls conjunctively define the longitudinal channel.

2. The toilet paper roll holder of claim 1, wherein the elongated member includes a longitudinal linear length ranging between 16 inches and 22 inches.

3. The toilet paper roll holder of claim 1, wherein the longitudinal channel is configured to engage the leg of the commode via a friction fit.

4. The toilet paper roll holder of claim 1, wherein the longitudinal channel includes a longitudinal linear length ranging between 16 inches and 22 inches.

5. The toilet paper roll holder of claim 1, wherein a longitudinal axis of the elongated member is offset relative to a longitudinal axis of the vertical portion.

6. The toilet paper roll holder of claim 5, wherein the horizontal portion extends orthogonally relative to the longitudinal channel of the elongated member, such that when the toilet paper roll holder is mounted onto a rear left leg of the commode, the vertical portion rests behind both the rear left leg of the commode and an arm rest adjacent the rear left leg of the commode.

7. The toilet paper roll holder of claim 1, wherein the horizontal portion comprises a planar plate configured to support a toilet paper roll flush thereon.

8. The toilet paper roll holder of claim 1, wherein the vertical portion comprises a tubular member sized and configured to receive a hollow interior portion of a cardboard cylinder of a toilet paper roll.

9. The toilet paper roll holder of claim 1, wherein the fastener comprises a strap including a hook and loop fastener configured to wrap around the leg of the commode and removably secure the leg within the longitudinal channel of the elongated member.

* * * * *